US006629881B1

(12) United States Patent
Redeker et al.

(10) Patent No.: US 6,629,881 B1
(45) Date of Patent: Oct. 7, 2003

(54) METHOD AND APPARATUS FOR CONTROLLING SLURRY DELIVERY DURING POLISHING

(75) Inventors: Fred C. Redeker, Fremont, CA (US); Rajeev Bajaj, Fremont, CA (US); Frank A. Bose, Capetown (ZA); A. Jason Whitby, San Jose, CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 09/505,902

(22) Filed: Feb. 17, 2000

(51) Int. Cl.[7] ..... B24B 57/00; B24B 49/00
(52) U.S. Cl. ..... 451/60; 451/5; 451/446
(58) Field of Search ..... 451/60, 5, 446, 451/288, 287

(56) References Cited

U.S. PATENT DOCUMENTS

| | | | | |
|---|---|---|---|---|
| 4,471,597 A | | 9/1984 | Bovensiepen | 51/165.73 |
| 5,407,526 A | | 4/1995 | Danielson et al. | 156/636 |
| 5,433,650 A | | 7/1995 | Winebarger | 451/6 |
| 5,527,161 A | | 6/1996 | Bailey et al. | 417/53 |
| 5,578,529 A | | 11/1996 | Mullins | 437/228 |
| 5,582,534 A | | 12/1996 | Shendon et al. | 451/41 |
| 5,605,488 A | | 2/1997 | Ohashi et al. | 451/7 |
| 5,630,527 A | | 5/1997 | Beebe et al. | 222/1 |
| 5,651,725 A | | 7/1997 | Kikuta et al. | 451/41 |
| 5,679,063 A | | 10/1997 | Kimura et al. | 451/287 |
| 5,702,563 A | | 12/1997 | Salugsugan et al. | 156/636.1 |
| 5,709,593 A | | 1/1998 | Guthrie et al. | 451/287 |
| 5,716,264 A | | 2/1998 | Kimura et al. | 451/443 |
| 5,738,574 A | | 4/1998 | Tolles et al. | 451/288 |
| 5,750,440 A | | 5/1998 | Vanell et al. | 438/692 |
| 5,762,537 A | * | 6/1998 | Sandhu et al. | 451/7 |
| 5,791,970 A | * | 8/1998 | Yueh | 451/60 |
| 5,816,900 A | | 10/1998 | Nagahara et al. | 451/285 |
| 5,820,448 A | | 10/1998 | Shamouilian et al. | 151/287 |
| 5,882,243 A | | 3/1999 | Das et al. | 451/5 |
| 5,887,974 A | | 3/1999 | Pozniak et al. | 366/136 |
| 5,888,121 A | | 3/1999 | Kirchner et al. | 451/41 |
| 5,893,753 A | | 4/1999 | Hempel, Jr. | 438/691 |
| 5,899,800 A | | 5/1999 | Shendon | 451/287 |
| 5,945,346 A | * | 8/1999 | Vanell et al. | 438/691 |
| 5,993,299 A | * | 11/1999 | Chen et al. | 451/60 |
| 6,012,967 A | | 1/2000 | Satake et al. | 451/36 |
| 6,056,631 A | | 5/2000 | Brown et al. | 451/288 |
| 6,059,920 A | * | 5/2000 | Melcer | 451/60 |
| 6,116,988 A | | 9/2000 | Ball | 451/41 |
| 6,183,341 B1 | * | 2/2001 | Melcer | 451/60 |
| 6,348,124 B1 | | 2/2002 | Garbett et al. | 156/345 |

OTHER PUBLICATIONS

U.S. patent application Ser. No. 09/461,685, Barrlett, filed Dec. 14, 1999.

* cited by examiner

*Primary Examiner*—Robert A. Rose
(74) *Attorney, Agent, or Firm*—Moser, Patterson & Sheridan

(57) ABSTRACT

A fluid delivery apparatus and method for use in a chemical mechanical polishing system is provided. The delivery rate of a fluid onto a pad is controlled to reduce the consumption of the fluid. In general, the fluid flow may be varied between a relatively lower flow rate and a relatively higher flow rate or, alternatively, the flow may be periodically terminated. Fluid flow may be controlled by any combination of pumps, controllers, valves, or other regulator/fluid flow control member.

35 Claims, 5 Drawing Sheets

METHOD AND APPARATUS FOR CONTROLLING SLURRY DELIVERY DURING POLISHING

BACKGROUND OF THE INVENTION

1. Field of the Invention

The present invention relates to an apparatus and method for polishing substrates. More particularly, the invention relates to the control of slurry delivery to a polishing pad.

2. Background of the Related Art

In the fabrication of integrated circuits and other electronic devices, multiple layers of conducting, semiconducting and dielectric materials are deposited and removed from a substrate during the fabrication process. Often it is necessary to polish a surface of a substrate to remove high topography, surface defects, scratches or embedded particles. One polishing process is known as chemical mechanical polishing (CMP) and is used to improve the quality and reliability of the electronic devices formed on substrates. An exemplary polishing system used to perform CMP is the Mirra® System available from Applied Materials, Inc., as shown and described in U.S. Pat. No. 5,738,574, entitled, "Continuous Processing System for Chemical Mechanical Polishing," the entirety of which is incorporated herein by reference.

Typically, the polishing process involves the introduction of a chemical slurry during the polishing process to facilitate higher removal rates and selectivity between films on the substrate surface. In general, the polishing process involves holding a substrate against a polishing pad under controlled pressure, temperature and rotational velocity of the pad in the presence of a slurry or other fluid medium. The slurry is primarily used to enhance the material removal rate of selected materials from the substrate surface. As a fixed volume of slurry in contact with the substrate reacts with the selected materials on the substrate surface, the slurry constituents are consumed. Accordingly, the slurry becomes less reactive and the polishing enhancing characteristics of the slurry are significantly reduced.

In an attempt to ensure a substantially constant and uniform removal rate of material from the substrate being polished, conventional methods continually supply large volumes of slurry to the pad during a polishing cycle. As a result, slurry is the primary consumable in chemical mechanical polishing and a significant source of the cost of operation. In order to minimize the cost of operation, the volume of slurry used in a processing cycle should be minimized.

Therefore, there is a need for a method of polishing a substrate while minimizing the volume of slurry consumed.

SUMMARY OF THE INVENTION

The present invention generally provides an apparatus and method for polishing a substrate which improves the delivery of slurry over the surface of a polishing pad while providing uniformity and planarity of the polishing process. The method is preferably adapted for incorporation into a chemical mechanical polishing system.

In one aspect of the invention, a polishing assembly is provided having a polishing pad and a fluid supply system including a fluid delivery arm and a fluid delivery module. The fluid delivery arm disposed near the polishing pad includes one or more delivery lines and at least one slurry delivery line. The fluid delivery module is coupled to the fluid delivery line and is adapted to regulate the flow of slurry during a polishing cycle. The fluid delivery module may include one or more of flow control valves, controllers and microprocessors used alone or in combination to control the rate at which slurry is delivered to the polishing pad.

In another aspect of the invention, a method of varying the rate of slurry flow onto a pad during polishing is provided. The method comprises flowing a fluid from a fluid delivery source while varying the flow rate of the fluid.

In yet another aspect of the invention, a method of polishing a substrate is provided. The method comprises positioning a substrate in contract with a polishing pad and supplying a fluid onto the pad while periodically varying the rate of fluid flow onto a pad. In one embodiment, the fluid flow may be continuous while the rate is varied or, alternatively, the fluid flow may be periodic so that fluid flow is turned OFF and ON.

In yet another aspect of the invention, a method of varying the rate of fluid flow onto a pad during polishing is provided. The method comprises providing a fluid delivery line adjacent a polishing pad, providing a slurry source coupled to the fluid delivery line, flowing a slurry from a slurry source through the fluid delivery line and onto the polishing pad, and varying the flow rate of the slurry out of the fluid delivery line and onto the polishing pad. In one embodiment, the fluid flow may be continuous while the rate is varied or, alternatively, the fluid flow may be periodic so that fluid flow is turned OFF and ON.

In still another aspect of the invention, a signal-bearing machine-readable medium includes a program which, when executed on the computer system, controls the fluid flow to a CMP system during processing. One embodiment of the program is adapted to utilize user-selected values for the rate of the fluid flow. Additionally or alternatively, an embodiment of the program is adapted to provide a continuous fluid flow while the rate is varied or, alternatively, a periodic fluid flow so that fluid flow is turned OFF and ON.

In still another aspect of the invention, a polishing system comprises one or more rotatable platens, a polishing pad disposed on each of the rotatable platens, a fluid supply system including a fluid source and a fluid delivery arm coupled thereto, and a computer system coupled at least to the fluid supply system and adapted to vary the flow rate of a fluid from the fluid delivery arm onto the polishing pad during a polishing cycle.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

The present invention generally relates to a fluid delivery apparatus and method for use in a chemical mechanical polishing system. In one embodiment, a fluid control unit regulates the rate of fluid flow from a supply unit to a polishing station. The fluid control unit includes any number of controllers, pumps, valves, or other regulator/fluid flow control member adapted to vary the fluid flow rate during a polishing cycle. A computer system operates the fluid control unit. In general, the fluid flow may be varied between a relatively lower flow rate and a relatively higher flow rate or, alternatively, the flow may be periodically terminated.

Figure 1:
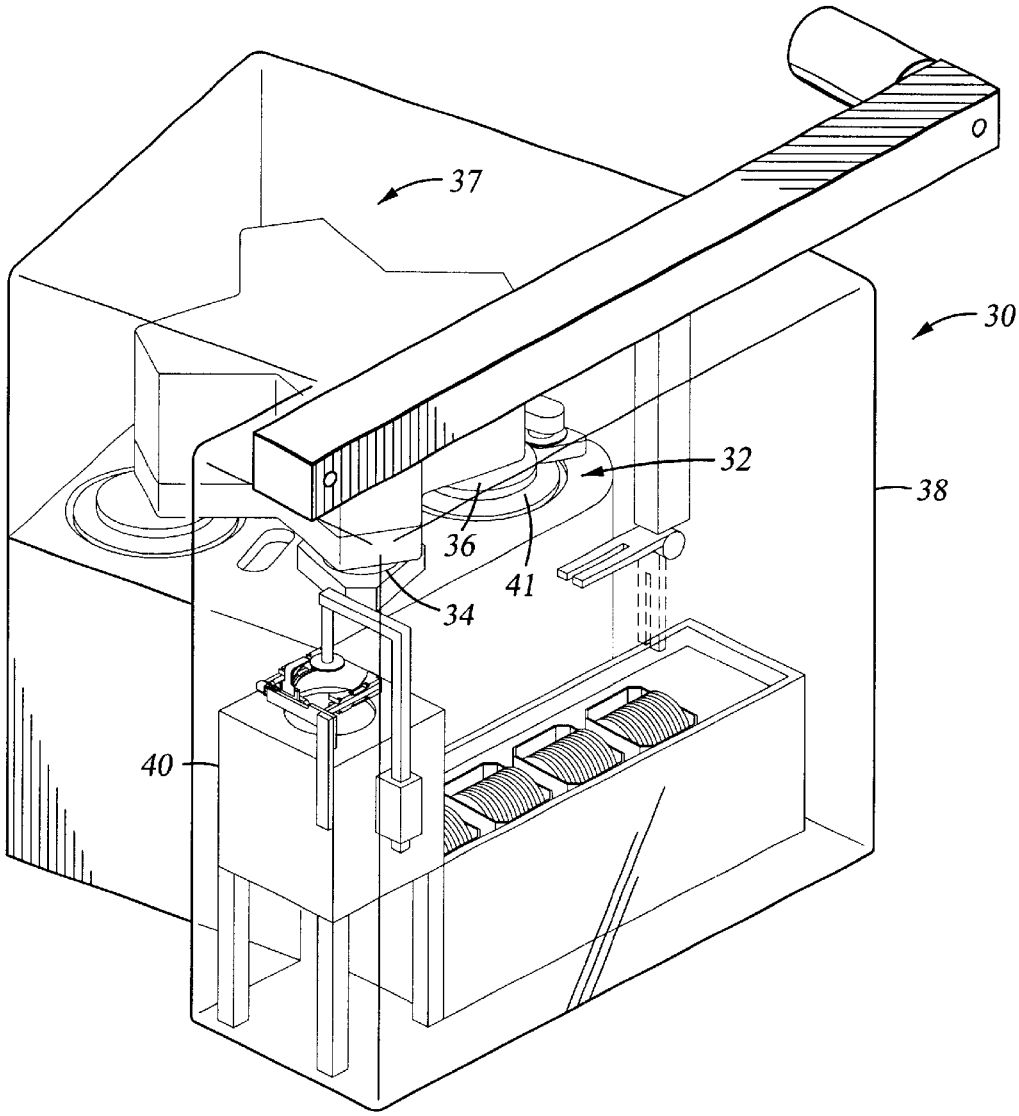
FIG. 1 is a schematic view of a CMP system.

FIG. 1 is a schematic view of a CMP system 30 of the invention. One such system is the Mirra® System available from Applied Materials, Inc., located in Santa Clara, Calif. The system shown includes three polishing stations 32 and a loading station 34. Four carrier heads 36 are rotatably mounted to a carrier head displacement mechanism 37 disposed above the polishing stations 32 and the loading station 34. A front-end substrate transfer region 38 is disposed adjacent to the CMP system and is considered a part of the CMP system, though the transfer region 38 may be a separate component. A substrate inspection station 40 is disposed in the substrate transfer region 38 to enable pre and/or post process inspection of substrates introduced into the system 30.

Typically, a substrate is loaded on a carrier head 36 at the loading station 34 and is then rotated through the three polishing stations 32. The polishing stations 32 each comprise a rotating platen 41 having polishing or cleaning pads mounted thereon. One process sequence includes a polishing pad at the first two stations and a cleaning pad at the third station to facilitate substrate cleaning at the end of the polishing process. At the end of the cycle the substrate is returned to the front-end substrate transfer region 38 and another substrate is retrieved from the loading station 34 for processing.

Figure 2:
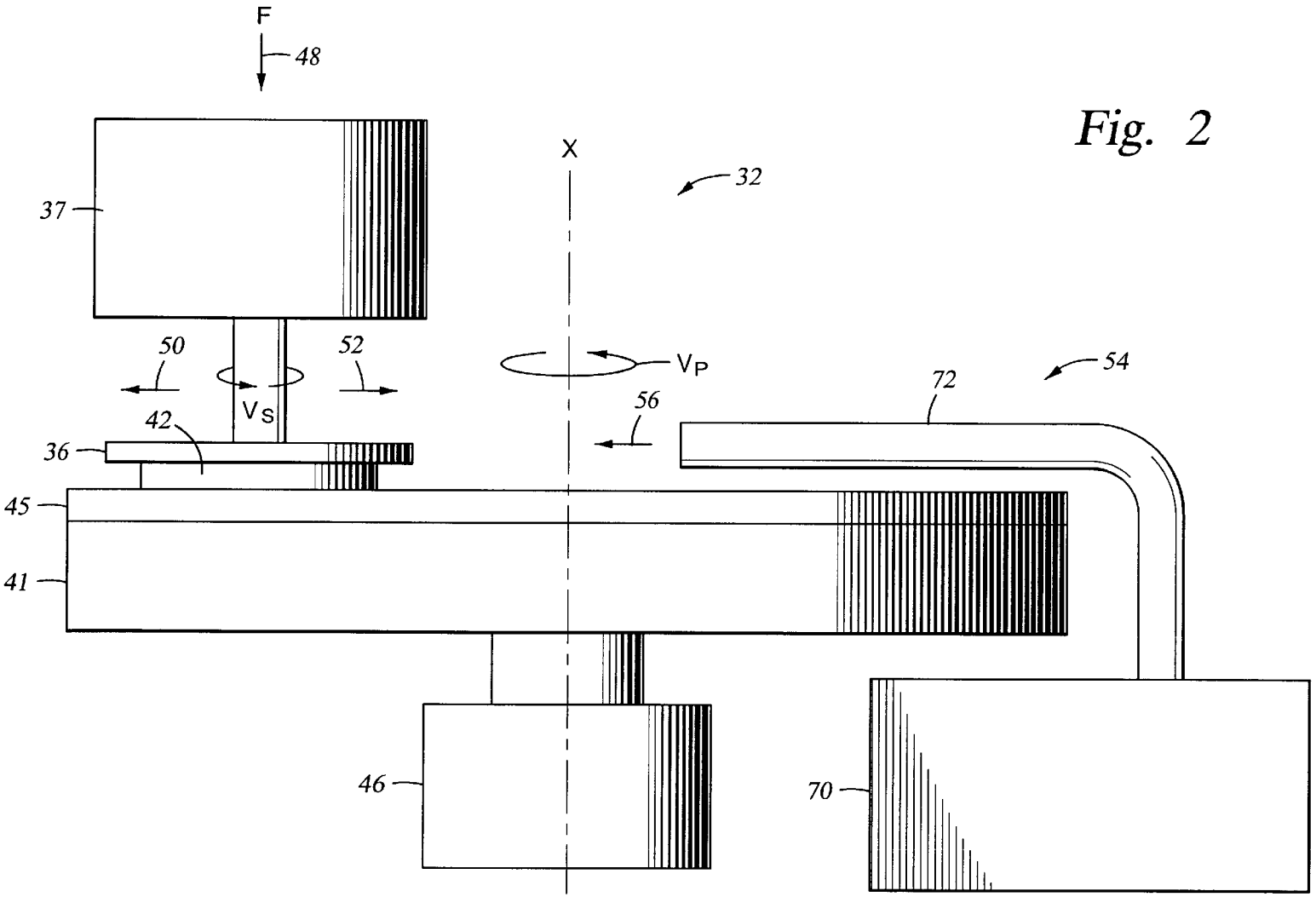
FIG. 2 is a schematic view of a polishing station.

FIG. 2 is a schematic view of a polishing station 32 and carrier head 36 used to advantage with the present invention. The polishing station 32 comprises a pad 45 secured to an upper surface of a rotatable platen 41. The pad 45 may utilize any commercially available pad supplied by manufacturers such as Rodel, Inc., of Newark, Del., and preferably comprises a plastic or foam such as polyurethane as described in detail below. The platen 41 is coupled to a motor 46 or other suitable drive mechanism to impart rotational movement to the platen 41. During operation, the platen 41 is rotated at a velocity $V_P$ about a center axis X. The platen 41 can be rotated in either a clockwise or counterclockwise direction.

FIG. 2 also shows the carrier head 36 mounted above the polishing station 32. The carrier head 36 supports a substrate 42 for polishing. The carrier head 36 may comprise a vacuum-type mechanism to chuck the substrate 42 against the carrier head 36. During operation, the vacuum chuck generates a negative vacuum force behind the surface of the substrate 42 to attract and hold the substrate 42. The carrier head 36 typically includes a pocket (not shown) in which the substrate 42 is supported, at least initially, under vacuum. Once the substrate 42 is secured in the pocket and positioned on the pad 45, the vacuum can be removed. The carrier head 36 then applies a controlled pressure behind the substrate, indicated by the arrow 48, to the backside of the substrate 42 urging the substrate 42 against the pad 45 to facilitate polishing of the substrate surface. The carrier head displacement mechanism 37 rotates the carrier head. 36 and the substrate 42 at a velocity $V_S$ in a clockwise or counterclockwise direction, preferably the same direction as the platen 41. The carrier head displacement mechanism 37 also preferably moves the carrier head 36 radially across the platen 41 in a direction indicated by arrows 50 and 52.

With reference to FIG. 2, the CMP system also includes a fluid supply system 54 for introducing a chemical slurry of a desired composition as well as deionized water to the polishing pad. The fluid supply system 54 includes a fluid delivery module 70 coupled to a fluid delivery arm 72. The fluid delivery arm 72 preferably includes a separate delivery line for at least slurry and water. The fluid delivery arm 72 is a top dispensing unit having its outlet positioned over the pad 45. During operation, the fluid supply system 54 introduces a fluid, as indicated by arrow 56, onto the pad 45 at a selected rate. Fluid is delivered to a central area of the pad 45 and then flows radially outwardly during rotation of the pad 45 due to the inertia of the fluid. In another embodiment, a fluid supply system provides fluid from below the pad 45 via a fluid delivery passage formed in the pad 45.

In some applications, a slurry provides an abrasive material that facilitates the polishing of a substrate surface, and is preferably a composition formed of solid alumina or silica. In other applications the pad 45 may have abrasive particles disposed thereon and require only that a liquid, such as deionized water, be delivered to the polishing surface of the pad 45.

It is noted that the above fluid supply system 54 allows different slurries to be supplied to the each of the polishing stations 32. Further, each of the polishing stations 32 are preferably equipped with a drain located below the platen 41 to collect most of the excess slurry for that polishing station 32. Accordingly, each drain can be isolated from corresponding drains at the other polishing stations 32. Hence, different slurries can be used at the different polishing stations 32 but their drains can be substantially isolated. The isolation alleviates disposal problems and permits recycling of slurry even in a complex process.

Figure 3:
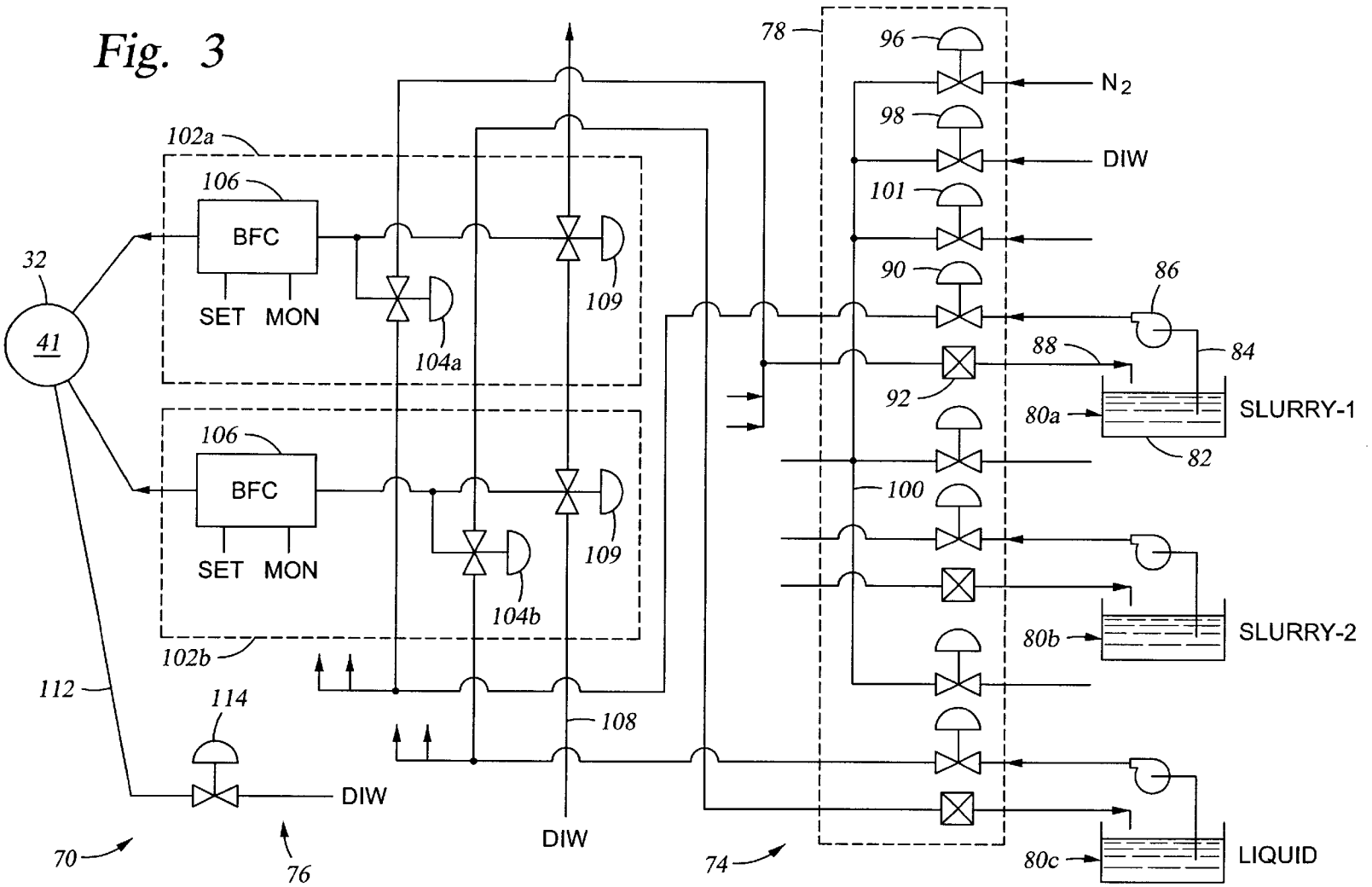
FIG. 3 is a schematic representation of a fluid delivery module.

An example of such the slurry delivery module 70 is schematically illustrated in FIG. 3. The figure illustrates a supply unit 74 for all three polishing stations 32 and one of three flow control units 76 for each respective polishing station 32. The supply unit 74 includes a bulkhead unit 78 containing pneumatic on-off valves and connecting piping. It also includes three fluid sources 80*a*, 80*b*, and 80*c*, each of which includes a supply tank 82, a supply tube 84 and associated pump 86, and a return tube 88 to provide a recirculating source of slurry or liquid. Associated level monitors and fresh supply tubes are not illustrated but are well known in the art. It is anticipated that two fluid sources 80*a* and 80*b* will be typically used for two different slurries while the third supply source 80*c* will be used for a non-slurry liquid chemical, such as ammonium hydroxide. Of course, a greater or lesser number of supply sources 80 may be used depending on the polishing requirements and requirements of the system.

The bulkhead unit 78 contains an on-off valve 90 for each supply line 84 and a flow check valve 92 for each return line 88. Although the illustrated bulkhead unit 78 uses only one supply valve 90 for all three polishing stations 32 so that the same liquids flow to all three stations, additional valving would allow independent and separate supplies to be provided at each polishing station 32. The bulkhead unit 78 also receives nitrogen and deionized water (DIW) through on-off valves 96 and 98, both of which connect to a purge line 100 gated to any of the supply sources 80*a*, 80*b*, or 80*c* through respective on-off valves 101. The nitrogen or DIW is used to purge and clear various lines as required. The purge connections are not illustrated. For clearing clogged lines, the purge connections can be manually made since the supply sources 80*a*, 80*b*, and 80*c* are located in an accessible area.

FIG. 3 shows two fluid sources 80*a* and 80*c* connected to the flow control unit 76 of the one illustrated polishing station 32 although the remaining supply unit 80*b* could be connected to one of the other polishing stations 32. Each flow control unit 76 includes two metering units 102*a* and 102*b*, each of which contains a diverter valve 104*a* or 104*b* connected to different recirculating paths from the fluid sources 80*a* and 80*c*. In general, a diverter valve selectively connects a third port to a flow path between its first two ports, which are in the recirculating path. The valved output of the diverter valve 104*a* or 104*b* is routed through a bulk flow controller 106 which will deliver a liquid flow rate to the associated slurry port at the platen 41 that is proportional to an analog control signal SET input to the bulk flow controller 106 from a computer system 110, described below with respect to FIG. 4. Although fluid equivalents to mass flow controllers could be used for the bulk flow controller 106, the required high levels of reliability with corrosive pump fluids have initially required use of a metering pump, such as a peristaltic pump which does not directly provide the monitoring function.

A line 108 carrying DIW is led through both metering units 102*a* and 102*b*, and respective diverter valves 109 direct DIW through the respective bulk flow controllers (BFC) 106. The DIW is used to flush the lines and clean the polishing pad 45 and/or substrate undergoing polishing, but it may also be used in other aspects of the polishing process, for example, at a polishing station 32 dedicated to buffing. Alternatively, a dedicated DIW line 112 and associated on-off valve 114 may be connected to the fluid delivery arm 72 at the platen 41.

Figure 4:
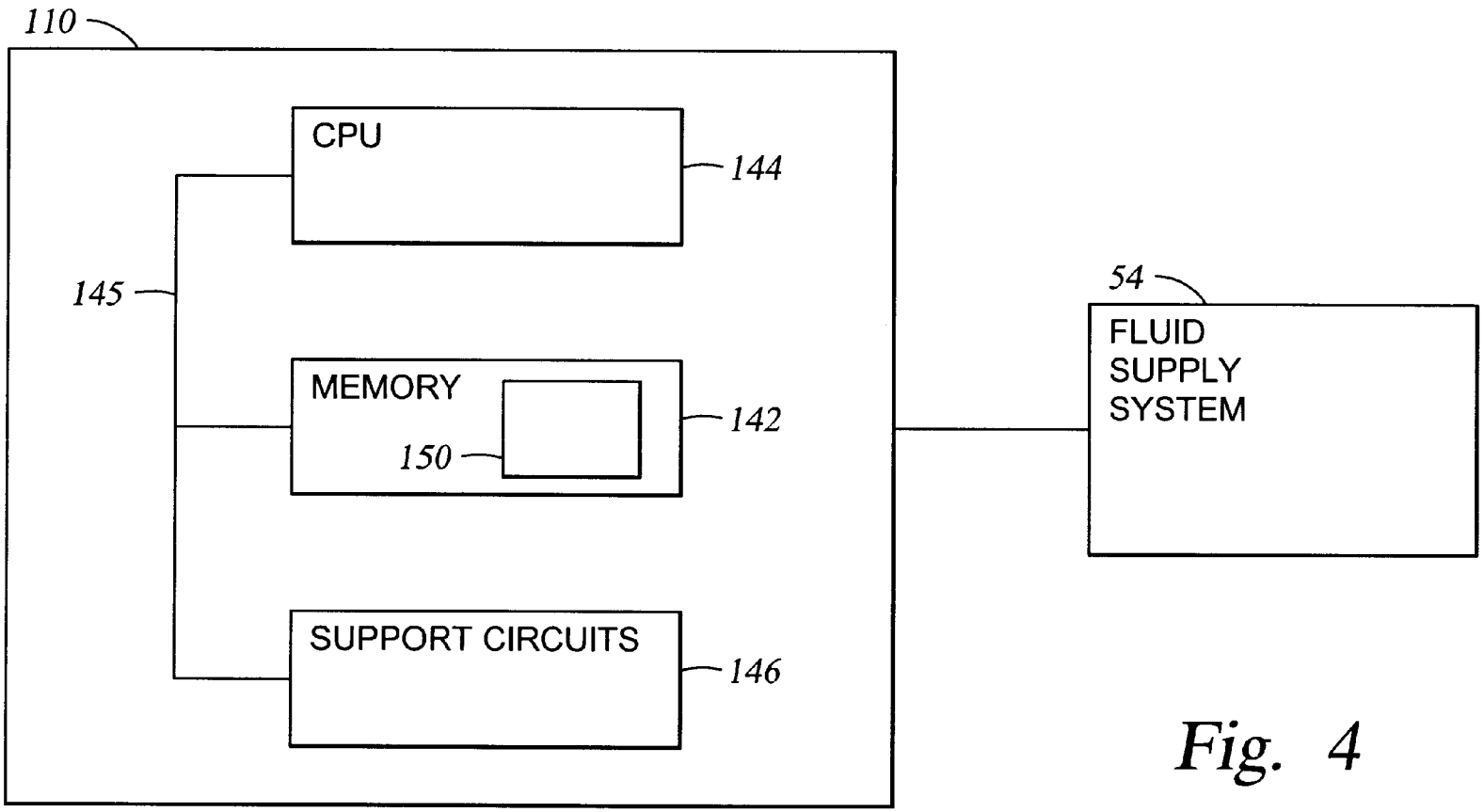
FIG. 4 is a schematic representation of a computer system coupled to the fluid delivery module of FIG. 3.

The control signal SET provided to the BFCs are generated at the computer system 110 shown in FIG. 4. The computer system 110 is shown coupled to the fluid delivery system 54 to regulate the flow of fluids to the polishing pads 45. However, more generally, the computer system 110 may also control the other various mechanisms of the CMP system 30, such as the carrier head 36, the motor 46, etc. (all shown in FIG. 2).

The computer system 110 includes a central processing unit (CPU) 144, a memory 142, support circuits 146 for the CPU 144 and a bus 145. The CPU 144 may be one of any form of general purpose computer processors that can be used in an industrial setting. The memory 142 is coupled to the CPU 144 to enable execution of a program product which is provided to the CPU 144 by the memory 142. The memory 142 is a computer-readable medium and may be one or more of readily available memory such as random access memory (RAM), read only memory (ROM), floppy disk drive, hard disk, or any other form of storage, local or remote. The support circuits 146 are coupled to the CPU 144 for supporting the processor in a conventional manner. These circuits include cache, power supplies, clock circuits, input/output circuitry and subsystems, and the like. The fluid flow rates for a polishing or buffing cycle are generally stored in the memory 142, typically as a software routine 150. The software routine 150 may also be stored and/or executed by a second CPU (not shown) that is remotely located from the hardware being controlled by the CPU 144. The software routine 150 is preferably a program product, or part of a program product, which allows a user to select a frequency for the flow rate of the fluid to be delivered to the pad 45.

In operation, a fluid, illustratively a slurry, is provided to the upper surface of the pad 45. A substrate is then brought into contact with the pad 45 to enable polishing of the substrate surface. Delivery of the slurry onto the pad 45 is preferably initiated prior to contact with the substrate. During at least a part of the processing cycle, the flow rate of fluid from the arm 72 onto the pad 45 is controlled to avoid unnecessary consumption of slurry. In general, the delivery of slurry is regulated so that the slurry on the pad 45 is efficiently consumed before fresh slurry is delivered.

The delivered flow rate is preferably measured and returned on a monitoring line MON. Accordingly, the flow rate may be monitored and adjusted as desired. In one embodiment, the fluid flow is periodic. Thus, the BFC 106 is operated to turn the flow ON and OFF intermittently at a desired frequency. In another embodiment, a fluid is flowed continuously while varying the rate of flow. Thus, for example, the flow rate may be modulated between a relatively high flow rate and a relatively low flow rate. The duration of the ON/HIGH flow and the OFF/LOW flow can be empirically determined to ensure efficient consumption of the slurry. A particular duty cycle may be determined according to the slurry consistency, the material being polished, the velocity of the polishing pad and other processing considerations known in the art. In one embodiment, the fluid is flowed for a first period of time at a first duty cycle and then flowed for a second period of time at a second duty cycle. Other variations are contemplated.

Figure 5:
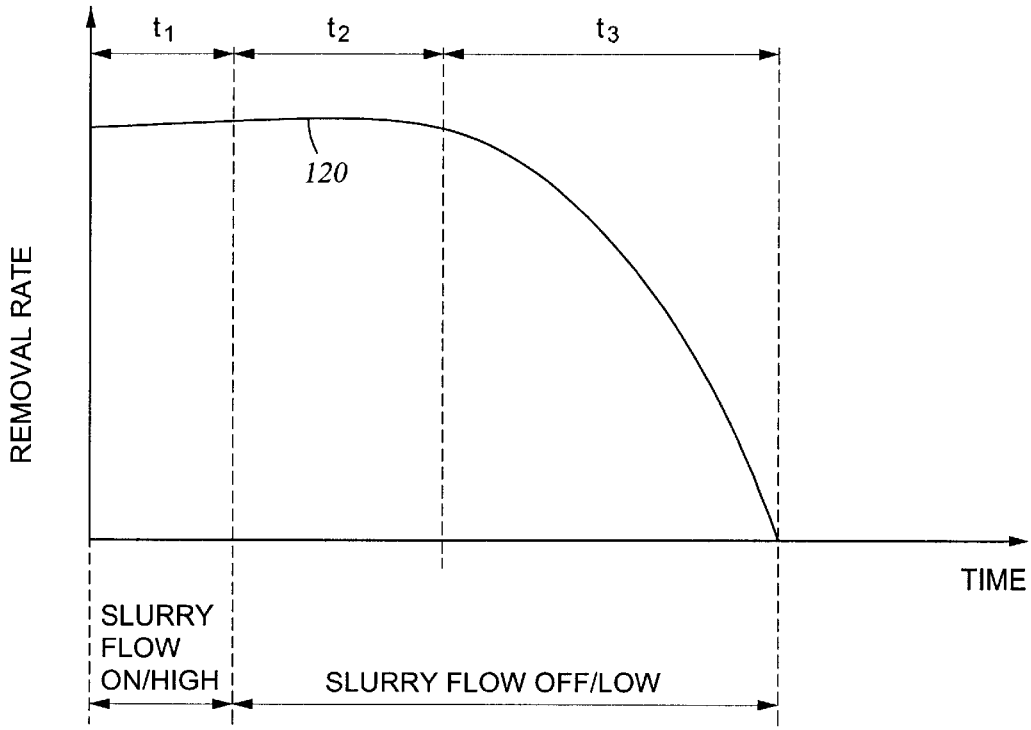
FIG. 5 is a graphical representation of a material removal rate from a substrate.

As noted above, the optimal delivery rate can be empirically determined. FIG. 5 is an illustrative graphical representation of the removal rate of material from a substrate over time for a given volume of slurry. During a first period of time, $t_1$, slurry is supplied to a pad at a first rate. Subsequently, the flow is either terminated or substantially reduced to a second rate, lower than the first rate. The removal rate curve 120 indicates a constant removal rate during to. Even after termination or reduction of the fluid delivery rate, the removal rate remains substantially constant during $t_2$. However, during $t_3$ the removal rate exhibits a decline, indicating that the slurry has been consumed to the point where it is no longer able to sustain a constant removal rate. Accordingly, by returning the flow rate of slurry to the rate maintained during $t_1$ substantially commensurate with the end of $t_2$, the removal rate can be maintained at a substantially constant level while minimizing the volume of slurry delivered to the pad.

Figure 6:
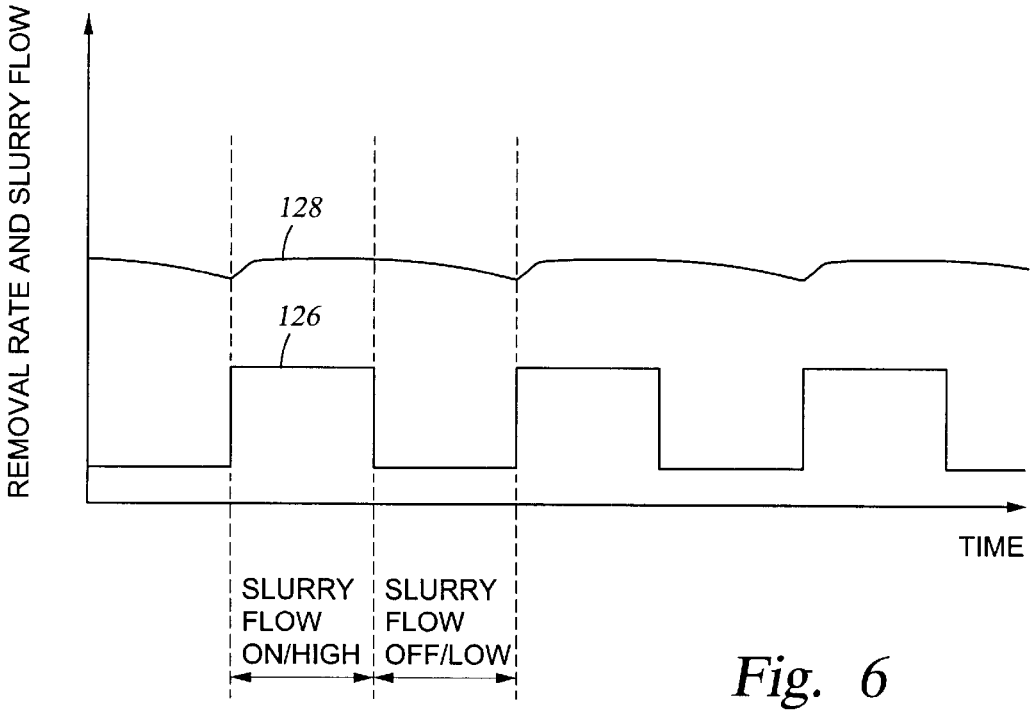
FIG. 6 is a graphical representation of a fluid flow rate and a material removal rate from a substrate.

FIG. 6 shows a graphical representation of a fluid flow rate and a removal rate of material from a substrate undergoing polishing. The fluid flow is timed to reduce the relative volume of fluid delivered to the polishing pad during the polishing cycle. Thus, a fluid flow curve 126 indicates a non-constant flow rate which may be either periodic, i.e., ON/OFF, or varied between a relatively higher flow rate (HIGH) and a relatively lower flow rate (LOW). The frequency and duty cycle of the flow rate is selected to maintain a substantially constant removal rate, as represented by the removal rate curve 128. Comparison to FIG. 5 indicates that the ON/HIGH portion of curve 126 is represented by $t_1$ in FIG. 5 and the OFF/LOW portion of curve 126 is represented by $t_2$ in FIG. 5.

Thus, in contrast to prior art methods and apparatus, the slurry delivery is non-continuous. By modulating the flow rate of the fluid accordingly, the total volume of slurry consumed during a polishing cycle can be reduced while the material removal rate is maintained substantially constant or otherwise within acceptable limits.

The fluid supply system 54 assumes a direct connection between the delivery module 70 (described with reference to FIG. 3) and the fluid delivery arm 72. However, in other embodiments, the module 70 may be coupled to a reservoir downstream from the fluid delivery arm 72. A pump then motivates fluid to flow onto the pad 45. In such an embodiment, fluid flow onto the pad 45 would be regulated by controlling the operation of the pump. Accordingly, the pump may be turned on an off periodically, or alternatively, the flow may be surged at a desired frequency. In either case, the flow rate can be determined by an input signal to the pump provided by the computer system 110 (shown in FIG. 4).

Further, the fluid supply system 54 and the CMP system 30 generally are merely illustrative. Other methods and devices known and unknown in the art may be used to control the flow of fluid onto a pad. For example, any combination of pumps, valves, controllers, etc. may be used to advantage.

While the foregoing is directed to the preferred embodiment of the present invention, other and further embodiments of the invention may be devised without departing from the basic scope thereof, and the scope thereof is determined by the claims that follow.

What is claimed is:

1. A method of delivering a slurry to a polishing pad, comprising:

(a) providing a slurry delivery device adjacent a polishing pad;

(b) providing a slurry source coupled to the slurry delivery device;

(c) flowing a slurry from the slurry source through the slurry delivery device and onto the polishing pad;

(d) polishing a substrate disposed on the polishing pad; and (e) during polishing of the substrate, programmatically, repeatedly and alternately, increasing and decreasing a flow rate of the slurry out of the slurry delivery device and onto the polishing pad according to a predefined signal defining the flow rate wherein the flow rate is predetermined according to a consumption rate of the slurry.

2. The method of claim 1, wherein the predefined signal causes a flow of the slurry to be turned ON and OFF at a constant predefined frequency.

3. The method of claim 1, wherein the increasing and decreasing is performed repeatedly and alternately over time during polishing of the substrate.

4. The method of claim 1, wherein (e) comprises periodically terminating a flow of the slurry to the polishing pad.

5. A polishing system, comprising:

(a) a polishing pad;

(b) a carrier head adapted to position a substrate in contact with the polishing pad;

(c) a slurry delivery arm including a slurry delivery line;

(d) a slurry source coupled to the slurry delivery line; and (e) a flow control apparatus adapted to programmatically, repeatedly and alternately, increase and decrease a flow rate of the slurry from the slurry source to the slurry delivery arm during polishing of a substrate on the polishing pad, wherein the flow rate is changed according to a predefined signal based on a consumption rate of the slurry.

6. A method of polishing a substrate, comprising:

(a) positioning a substrate in contact with a polishing pad; and (b) during polishing of the substrate, supplying a slurry onto the pad at a programmatically, repeatedly and alternately, increasing and decreasing flow rate according to a predefined signal, wherein the flow rate is predetermined according to a consumption rate of the slurry.

7. The method of claim 6, wherein supplying the slurry comprises flowing the slurry from a delivery arm.

8. The method of claim 6, further comprising rotating the polishing pad.

9. The method of claim 6, wherein supplying fluid onto the pad comprises periodically terminating a flow of slurry.

10. The method of claim 6, wherein supplying the slurry onto the pad comprises supplying the slurry for a period of time at a first duty cycle and then supplying the slurry for a second period of time at a second duty cycle.

11. A method of delivering a slurry to a polishing pad, comprising flowing the slurry from a fluid delivery source while programmatically periodically terminating a flow of the slurry during polishing of a substrate on the polishing pad according to a predefined signal defining a varying flow rate predetermined according to a consumption rate of the slurry.

12. The polishing system of claim 5, wherein the flow control apparatus comprises a variable valve.

13. The method of claim 11 further comprising rotating the polishing pad.

14. The polishing system of claim 5, wherein the flow control apparatus comprises a flow controller.

15. The polishing system of claim 5, wherein the flow control apparatus includes a variable valve and a controller adapted to control the variable valve.

16. A signal-bearing medium containing a program that, when executed by a processor, causes one or more controllers to perform the steps of:

(a) flowing a slurry onto a polishing pad;

(b) polishing a substrate disposed on the polishing pad; and (c) programmatically, repeatedly and alternately, increasing and decreasing a flow rate of the slurry during polishing of a substrate on the polishing pad according to a predefined signal defining the flow rate, wherein the flow rate is predetermined according to a consumption rate of the slurry.

17. The signal-bearing medium of claim 16, wherein (c) comprises at least one of periodically terminating the flow of the slurry onto the polishing pad, varying the flow rate between a relatively higher flow rate and a relatively lower flow rate and any combination thereof.

18. The polishing system of claim 5, further comprising a controller operated by a computer system.

19. The signal-bearing medium of claim 16, wherein the program is adapted to accept user-selected information comprising at least flow rates.

20. The signal-bearing medium of claim 16, further comprising a flow controller operated by execution of the program.

21. The signal-bearing medium of claim 16, wherein the program, when executed by a processor, causes one or more controllers to perform the step of performing (c) while contacting a substrate with the polishing pad.

22. An apparatus for polishing a substrate, comprising:

(a) one or more rotatable platens; and (b) a polishing pad disposed on each of the rotatable platens;

(c) a slurry supply system including a slurry source and a slurry delivery arm coupled thereto; and (d) a computer system coupled at least to the slurry supply system and adapted to programmatically, repeatedly and alternately, increase and decrease a flow rate of a slurry from the slurry delivery arm onto at least one polishing pad during a polishing cycle, wherein the flow rate is changed according to a predefined signal predetermined according to a consumption rate of the slurry.

23. The apparatus of claim 22, further comprising a machine-readable program product containing instructions use to produce the predefined signal.

24. The apparatus of claim 22 wherein the computer system is configured to programmatically, repeatedly and alternately, increase and decrease the flow rate by varying the flow rate between a relatively lower flow rate and a relatively higher flow rate during a polishing cycle of the substrate.

25. The method of claim 1, wherein (e) comprises supplying the slurry for a first period of time at a first duty cycle and then supplying the slurry for a second period of time at a second duty cycle.

26. The method of claim 11, wherein flowing the slurry comprises supplying the slurry for a first period of time at a first duty cycle and then supplying the slurry for a second period of time at a second duty cycle.

27. The polishing system of claim 5, wherein the flow control apparatus is adapted to supply the slurry for a first period of time at a first duty cycle and for a second period of time at a second duty cycle.

28. The method of claim 1, wherein a lower limit flow rate defined by the predefined signal is zero.

29. The apparatus of claim 22, wherein the repeatedly and alternately increasing and decreasing is performed at a substantially constant predefined frequency.

30. The apparatus of claim 22, wherein the computer system is configured to programmatically, repeatedly and alternately, increase and decrease the flow rate by flowing the slurry and periodically ceasing the flow of slurry during the polishing cycle of the substrate.

31. The method of claim 6, wherein supplying the slurry onto the pad comprises varying the flow rate of the slurry at a constant predefined frequency.

32. The method of claim 6, wherein the increasing and decreasing is performed repeatedly and alternately over time during polishing of the substrate.

33. The method of claim 11, wherein the periodically terminating is performed at a substantially constant predefined frequency.

34. The method of claim 16, wherein the repeatedly and alternately increasing and decreasing is performed at a substantially constant predefined frequency.

35. The polishing system of claim 5, wherein the repeatedly and alternately increasing and decreasing is performed at a substantially constant predefined frequency.

* * * * *

UNITED STATES PATENT AND TRADEMARK OFFICE

CERTIFICATE OF CORRECTION

PATENT NO. : 6,629,881 B1
DATED : October 7, 2003
INVENTOR(S) : Redeker et al.

It is certified that error appears in the above-identified patent and that said Letters Patent is hereby corrected as shown below:

Column 6,
Line 42, please change "to" to -- $t_1$ --.

Column 7,
Lines 50-52, please delete Claim 3 in its entirety.

Column 10,
Lines 18-20, please delete Claim 32 in its entirety.

Signed and Sealed this

Eighteenth Day of May, 2004

JON W. DUDAS
*Acting Director of the United States Patent and Trademark Office*